US005859653A

United States Patent [19]

Aoki et al.

[11] Patent Number: 5,859,653

[45] Date of Patent: Jan. 12, 1999

[54] INK JET RECORDING APPARATUS FOR MAINTAINING CONSTANT DISTANCE BETWEEN RECORDING HEAD AND RECORDING MEDIUM

[75] Inventors: Noriyuki Aoki; Akio Okubo, both of Tokyo; Atsushi Saito; Keizo Sasai, both of Yokohama; Katsumi Obana, Funabashi; Yasuhiko Ikeda, Sagamihara; Yukio Nohata; Shigeyuki Sugiyama, both of Yokohama, all of Japan

[73] Assignee: Canon Kabushiki Kaisha, Tokyo, Japan

[21] Appl. No.: 946,569

[22] Filed: Oct. 7, 1997

Related U.S. Application Data

[63] Continuation of Ser. No. 345,403, Nov. 21, 1994, abandoned.

[30] Foreign Application Priority Data

Nov. 25, 1993 [JP] Japan ..... 5-295374

[51] Int. Cl.[6] ..... B41J 2/01

[52] U.S. Cl. ..... 347/8; 347/37; 347/104; 400/323

[58] Field of Search ..... 347/8, 37, 104, 347/40; 400/323

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,868,674 | 9/1989 | Nakamura et al. | 358/296 |
| 5,065,169 | 11/1991 | Vincent et al. | 347/8 |

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 403182356 | 8/1991 | Japan | 347/8 |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A wheel for maintaining a constant distance between an ink discharge plane of a recording head and a recording sheet is provided on a carriage such that it is upstream of the recording head as viewed in the direction of movement of the recording head in a unidirectional print mode. A sensor monitors whether the recording sheet is moved off a contact of a feed roller which feeds the recording sheet to a record position and a pinch roller. Before a trailing edge of the recording sheet is moved off the contact of the feed roller and the pinch roller, bilateral recording is conducted to print in each of forward movement and backward movement of the carriage. When the sensor detects that the trailing edge of the recording sheet has been moved off the contact of the feed roller and the pinch roller, the recording is switched to unilateral printing. The print range at the trailing edge of the recording medium is thus extended.

23 Claims, 9 Drawing Sheets

FROM LINE
19
NCU
20
MODEM
21
MAIN CONTROLLER
22
INPUT IMAGE MEMORY
23
BLOCK MEMORY
24
DATA TRANSFER CIRCUIT
25
HEAD
26
RECORD CONTROLLER
27
CARRIAGE DRIVER
28
RECORDING PAPER CARRIER
29
CONSOLE UNIT
30
RECORDING PAPER TRA-ILING EDGE SENSOR

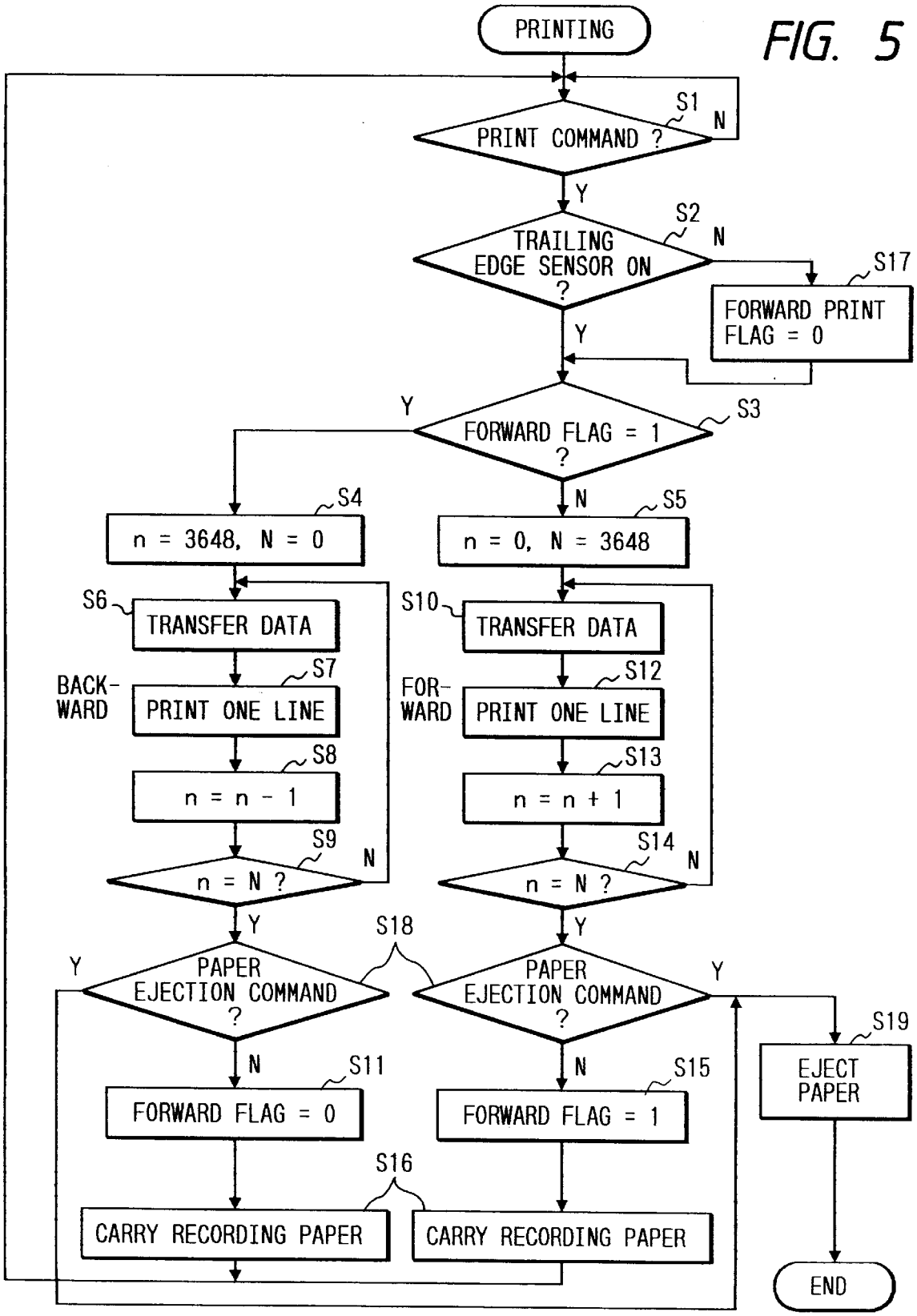
FIG. 5
PRINTING
S1
PRINT COMMAND ?
N
Y
S2
TRAILING EDGE SENSOR ON ?
N
S17
FORWARD PRINT FLAG = 0
Y
Y
S3
FORWARD FLAG = 1 ?
N
S4
n = 3648, N = 0
S5
n = 0, N = 3648
S6
TRANSFER DATA
S10
TRANSFER DATA
BACK-WARD
S7
PRINT ONE LINE
FOR-WARD
S12
PRINT ONE LINE
S8
n = n - 1
S13
n = n + 1
S9
n = N ?
N
S14
n = N ?
N
Y
S18
Y
Y
PAPER EJECTION COMMAND ?
PAPER EJECTION COMMAND ?
Y
S19
EJECT PAPER
N
S11
FORWARD FLAG = 0
N
S15
FORWARD FLAG = 1
S16
CARRY RECORDING PAPER
CARRY RECORDING PAPER
END

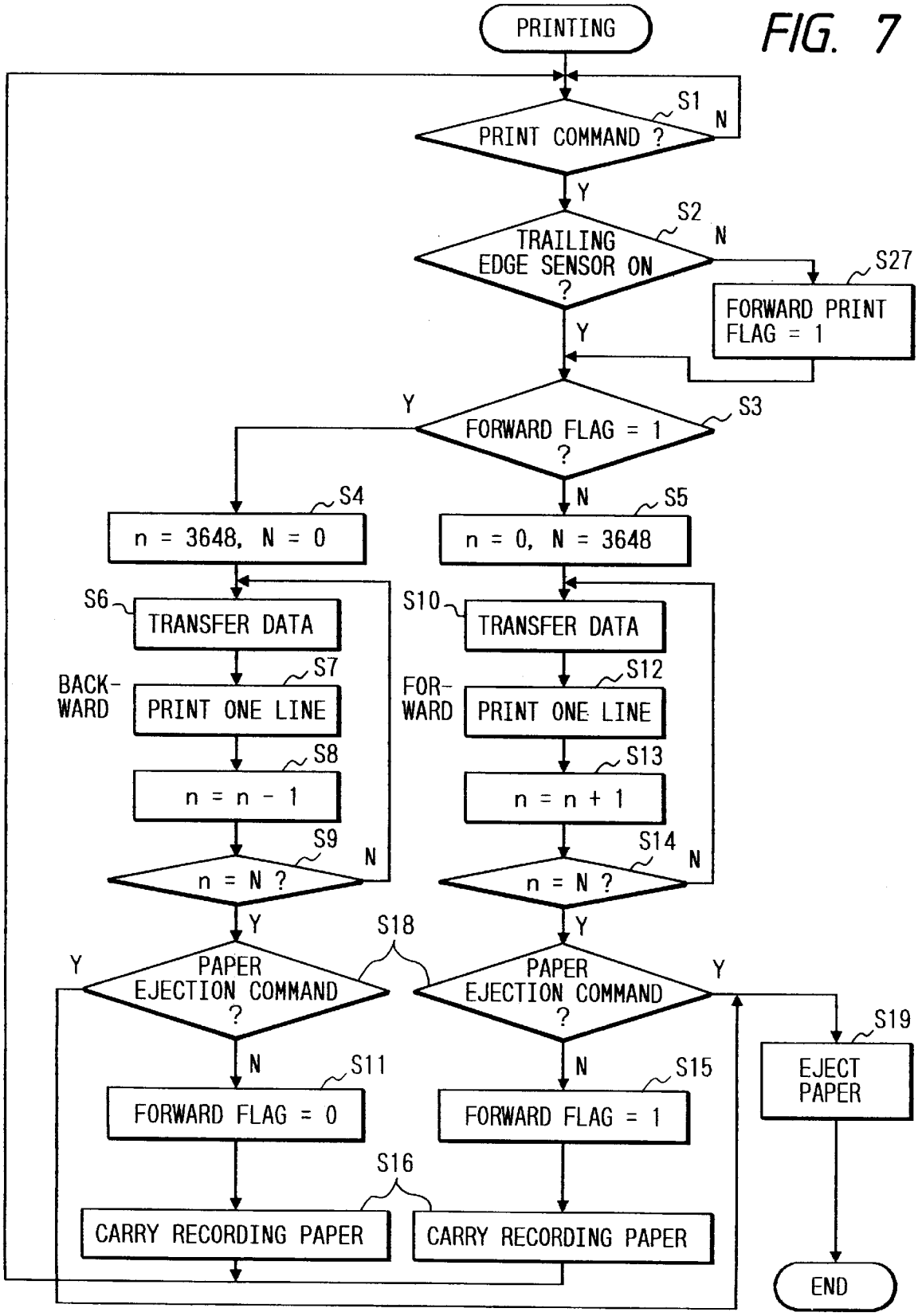
FIG. 7
PRINTING
S1
PRINT COMMAND ?
N
Y
S2
TRAILING EDGE SENSOR ON ?
N
S27
FORWARD PRINT FLAG = 1
Y
Y
FORWARD FLAG = 1 ?
S3
N
S4
n = 3648, N = 0
S5
n = 0, N = 3648
S6
TRANSFER DATA
S10
TRANSFER DATA
BACK-WARD
S7
PRINT ONE LINE
FOR-WARD
S12
PRINT ONE LINE
S8
n = n - 1
S13
n = n + 1
S9
n = N ?
N
S14
n = N ?
N
Y
S18
Y
PAPER EJECTION COMMAND ?
PAPER EJECTION COMMAND ?
Y
S19
EJECT PAPER
N
S11
FORWARD FLAG = 0
N
S15
FORWARD FLAG = 1
S16
CARRY RECORDING PAPER
CARRY RECORDING PAPER
END

INK JET RECORDING APPARATUS FOR MAINTAINING CONSTANT DISTANCE BETWEEN RECORDING HEAD AND RECORDING MEDIUM

This application is a continuation of application Ser. No. 08/345,403 filed Nov. 21, 1994, now abandoned.

BACKGROUND OF THE INVENTION

1. Field of the Invention

The present invention relates to an ink jet recording apparatus for recording an image by discharging ink droplets to a recording medium.

2. Related Background Art

In a prior art so-called ink jet recording apparatus, a distance between an ink discharge plane of a recording head and a recording medium such as a recording sheet or a plastic sheet (sheet distance) greatly affects a quality of a recorded image. The shorter the sheet distance is, the more the image quality is improved, but if it is too short, the ink discharge plane may contact the recording sheet due to unevenness of the recording sheet, which deteriorates the image quality. A current target for the sheet distance is approximately 0.7 to 1.2 mm.

FIG. 4 shows a front view of a construction of a carriage 6 which mounts an ink jet cartridge 3 in such a recording apparatus. Numeral 1 denotes a recording head integrated with the ink jet cartridge 3, and numeral 2 denotes a carriage wheel attached to the carriage 6 to reciprocally move the carriage 6 while maintaining a constant distance between an ink discharge plane of the recording head 1 and a recording sheet 4 (sheet distance). The carriage wheel 2 is made of a material which prevents the transfer of ink even if it contacts a recording plane of the recording sheet after printing.

A positional relation between the recording head 1 and the carriage wheel 2 is such that the carriage wheel 2 is upstream of the recording head 1 as viewed in the direction of forward (direction A) printing. Thus, the recording sheet 4 is biased to the platen 5 by the carriage wheel 2 to keep a constant sheet distance when the carriage 6 is driven forwardly in the stationary state of the recording sheet 6 in which the recording sheet 6 is off the contact of a feed roller 12 and a pinch roller 13.

FIG. 10 shows a main part of the recording apparatus. The recording sheet 4 is fed while it is pinched by the feed roller 12 and the pinch roller 13. When the recording sheet 4 reaches a record position, a pulley 7 is rotated so that the carriage 6 is reciprocally driven perpendicularly to the direction of feed of the recording sheet along a guide rail 9 to conduct a recording scan. The recording scan is conducted in each of the forward movement and the backward movement of the carriage 6. When one recording scan is completed, the sheet is fed in accordance with a recording width of the recording head 1. This process is repeated several times to complete one page of image recording. A sheet eject roller 14 and a wheel 15 are arranged downstream of the recording apparatus to feed the recording sheet after the recording.

In the prior art apparatus, when a trailing end of the recording sheet 4 moves away from the contact of the feed roller 12 and the pinch roller 13, the recording sheet 4 is no longer biased by the platen 5 and the sheet distance becomes stable. Thus, in the bilateral printing, the recording sheet 4 is biased to the platen 5 in the forward printing because the carriage wheel 2 is upstream of the recording head 1 as viewed in the print direction so that the sheet distance may be maintained constant, but in the backward printing, the recording sheet 4 is not biased to the platen 4 because the carriage wheel 2 is downstream of the recording head 1 as viewed in the print direction so that the ink discharge plane may contact the recording sheet 4 and the image quality is deteriorated. Thus, the apparatus is controlled to stop the printing when the recording sheet 4 moves away from the contact of the feed roller 12 and the pinch roller 13. Accordingly, the print range is narrowed.

SUMMARY OF THE INVENTION

It is an object of the present invention to provide an improved ink jet recording apparatus.

It is another object of the present invention to provide an ink jet recording apparatus which can extend a print range at a trailing edge of a recording sheet.

It is a further object of the present invention to provide an ink jet recording apparatus which can extend the print range at the trailing edge of the recording sheet and shorten a print time.

It is a still further object of the present invention to provide an ink jet recording apparatus which can extend the print range at the trailing edge of the recording sheet by conducting bilateral printing before the trailing edge of the recording sheet passes through feed means for feeding the recording sheet relative to a record position and conducting unilateral recording after the trailing edge of the recording sheet has passed through the feed means.

It is a still further object of the present invention to provide an ink jet recording head which can extend the print range at the trailing edge of the recording sheet and shorten the print time by providing members to keep a constant distance between an ink discharge plane of the recording head and the recording sheet at both upstream and downstream sides of the recording head as viewed in the direction of movement of the recording head and conducting the bilateral printing without regard to the passage of the trailing edge of the recording sheet through the feed means for feeding the recording sheet relative to the record position.

Those and other objects will be apparent from the accompanying drawings and the following description.

BRIEF DESCRIPTION OF THE DRAWINGS

FIG. 5 shows a flow chart illustrating a control operation in the first embodiment and a third embodiment of the present invention.

FIG. 7 shows a flow chart illustrating a control operation in the second embodiment and a fourth embodiment.

DETAILED DESCRIPTION OF THE PREFERRED EMBODIMENTS

Preferred embodiments of the present invention are explained in conjunction with the accompanying drawings.

[Embodiment 1]

Figure 1:
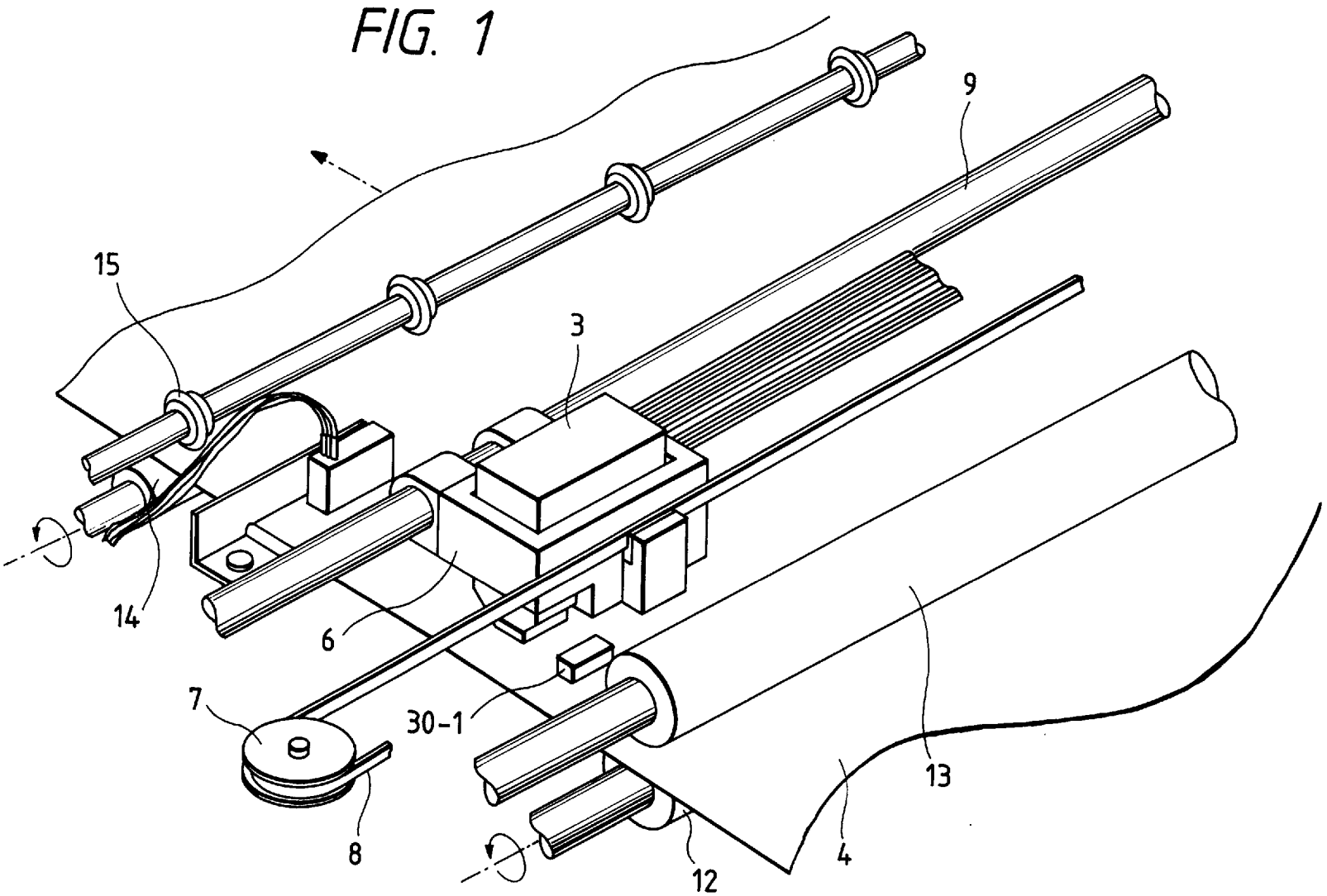
FIG. 1 shows a perspective view of a construction of an ink jet recording apparatus of the present invention.
Figure 2:
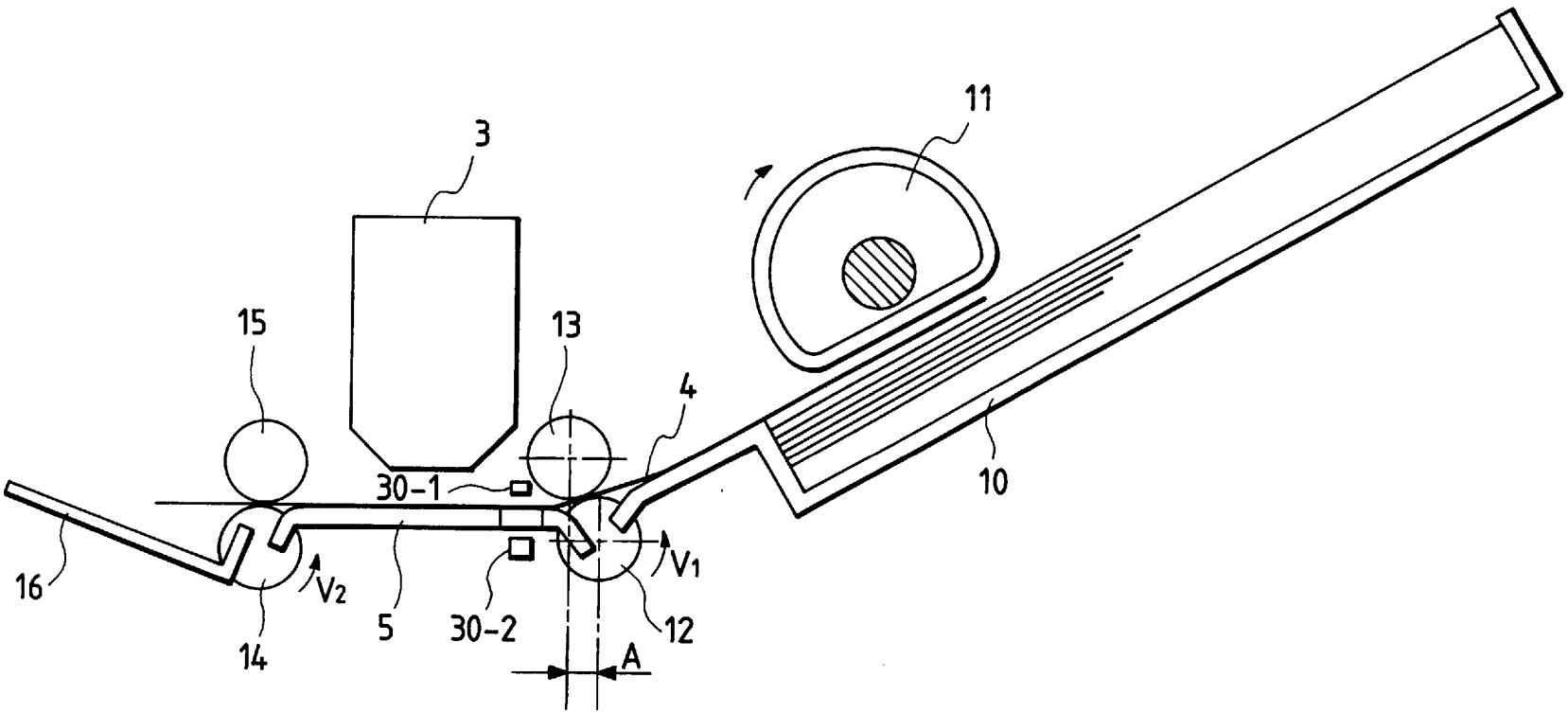
FIG. 2 shows a sectional view of the construction of the ink jet recording apparatus of the present invention.

FIG. 1 shows a perspective view of a construction of a recording unit of an ink jet recording apparatus in which the present invention is applied to a facsimile apparatus, and FIG. 2 shows a sectional view thereof. In FIGS. 1 and 2, numeral 3 denotes an ink jet cartridge of a disposable type with a recording head and an ink tank integrated therein, numeral 4 denotes a recording sheet which is a recording medium, numeral 5 denotes a platen arranged to face the ink jet cartridge 3 for supporting the recording sheet 4 which is the recording medium, and numeral 6 denotes a carriage for carrying the ink jet cartridge 3 to scan the recording sheet 4 widthwise. A timing endless belt 8 spanned to a pulley 7 which is driven by a drive source, not shown, is coupled to the carriage 6 which is reciprocally driven along a guide rail 9 by rotating the pulley 7. The present embodiment is operable in a bilateral record mode in which the recording is made in each of the forward and backward movements and in a unilateral record mode in which the recording is made in only one of the forward and backward movements. Numeral 10 denotes a sheet feed tray which can store a plurality of recording sheets in stack and numeral 11 denotes a pickup roller for separating and feeding the top one of the recording sheets 4 stacked in the cassette 10 one at a time. Numerals 12 and 13 denote a feed roller and a pinch roller which are upstream guide means for the recording sheet 4. The feed roller 12 and the pinch roller 13 are press-contacted and feed the recording sheet 4 taken out by the pickup roller 11 to a record position of the downstream platen 5. Numerals 14 and 15 denote a sheet feed roller and a wheel which are downward guide means of the recording sheet 4. A plurality of wheels 15 are axially arranged and made of a material which prevents the transfer of ink even if they contact a recording plane of the recording sheet 4 after recording. The recording sheet 4 is ejected to a sheet eject tray 16 by feeding the recording sheet 4 after recording of an image by the cooperation of the sheet feed roller 14 and the wheels 15. Numerals 30-1 and 30-2 denotes a light emitting device and a photosensing device which form a light transmission type sensor which in turn forms a sensor 30 for detecting a trailing edge of the recording sheet.

A recording operation of the recording apparatus thus constructed is now explained. When a signal to start the record operation is issued, the pickup roller 11 starts to rotate in a direction shown in FIG. 2 (clockwise) and the top one of the recording sheets 4 stacked on the sheet feed tray 10 is separated one at a time. The recording sheet 4 taken out by the pickup roller 11 is fed while it is pinched by the feed roller 12 and the pinch roller 13 and reaches the record position on the platen 5. The recording operation is conducted by discharging ink from the ink jet cartridge 3 in accordance with image information while the carriage 6 is reciprocally moved. The recording sheet 4 after the recording is held and fed by the sheet eject roller 14 and the wheel 15 and sequentially ejected and stacked on the sheet eject tray 16.

Referring to FIG. 2, a specific construction of the guide means in the recording apparatus is explained. As shown in FIG. 2, horizontal center axes of the feed roller 12 and the pinch roller 13 are shifted such that the center axis of the pinch roller 13 is shifted toward the downstream of the direction of feed of the recording sheet by a distance A. Due to the shift of the center axis of the pinch roller 13, the recording sheet 4 is fed downward, and when the leading edge abuts against the platen 5, it is fed while it is biased to the upper surface of the platen 5. The recording sheet 4 is bent by the contact to the platen 5 and the recording sheet 4 is fed while it is biased to the platen 5 by the bending. The amount of shift of the center axis of the pinch roller 13 is, of course, smaller than a radius $R_1$ of the feed roller 12, and preferably $$A<R_1 \sin 30^\circ$$

from the standpoint of the reliability of the apparatus. The vertical center axes of the sheet eject roller 14 and the wheel 15 are on a line. A positional relation of the platen 5 and the respective rollers is such that the contact of the feed roller 12 and the pinch roller 13 is about (facing the cartridge) the sheet pass plane (upper plane) of the platen 5. Thus, the recording sheet 4 is fed downward by the feed roller 12 and the pinch roller 13 and the downstream side of the recording sheet 4 is biased to the platen 5. The contact of the sheet eject roller 14 and the wheel 15 is located below the upper surface of the platen 5.

A circumferential velocity relation between the feed roller 12 and the eject roller 14 is set to meet $$v_1>v_2$$

where $v_1$ is a circumferential velocity of the feed roller 12 and $v_2$ is a circumferential velocity of the eject roller 14 such that the feed roller 12 presses the recording sheet 4 to the platen 5 to brake the recording sheet 4 by the eject roller 14. If the feed force of the eject roller 14 is large, the recording sheet 4 is flexed upward of the platen 5. Accordingly, the feed force of the eject roller 14 is set sufficiently low and the recording sheet 4 is fed while it slips on the platen 5 by a flexure restore force of the recording sheet 4.

Figure 4:
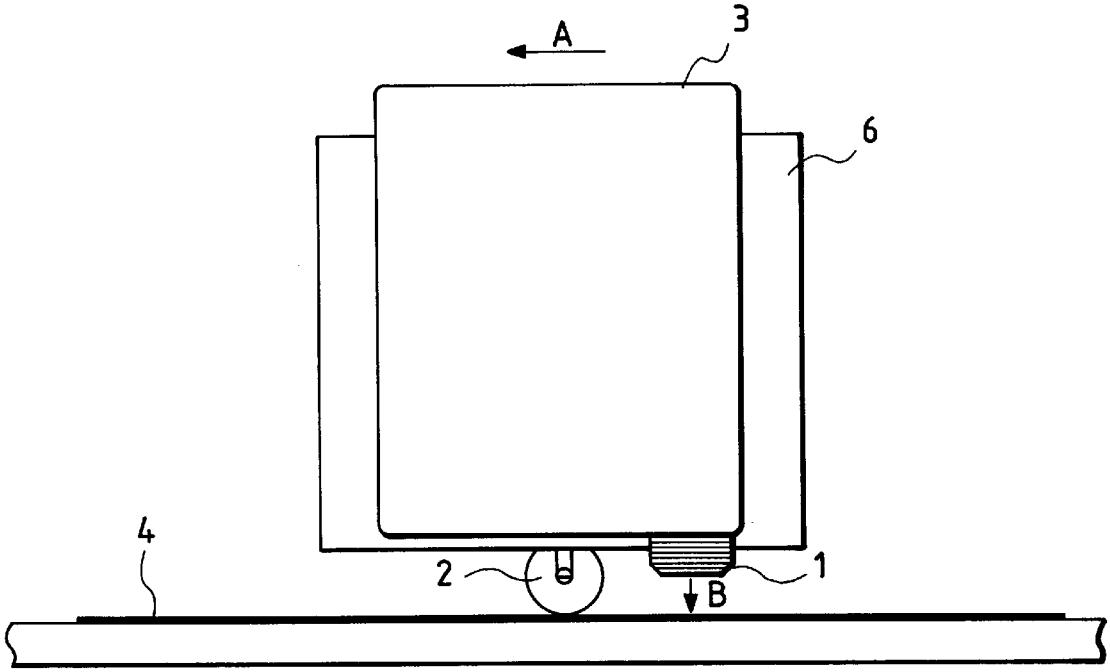
FIG. 4 shows a front view of a construction of a carriage in a first embodiment of the present invention.

The construction of the carriage 6 in the present embodiment is identical to that of FIG. 4 and the explanation thereof is omitted.

Figure 3:
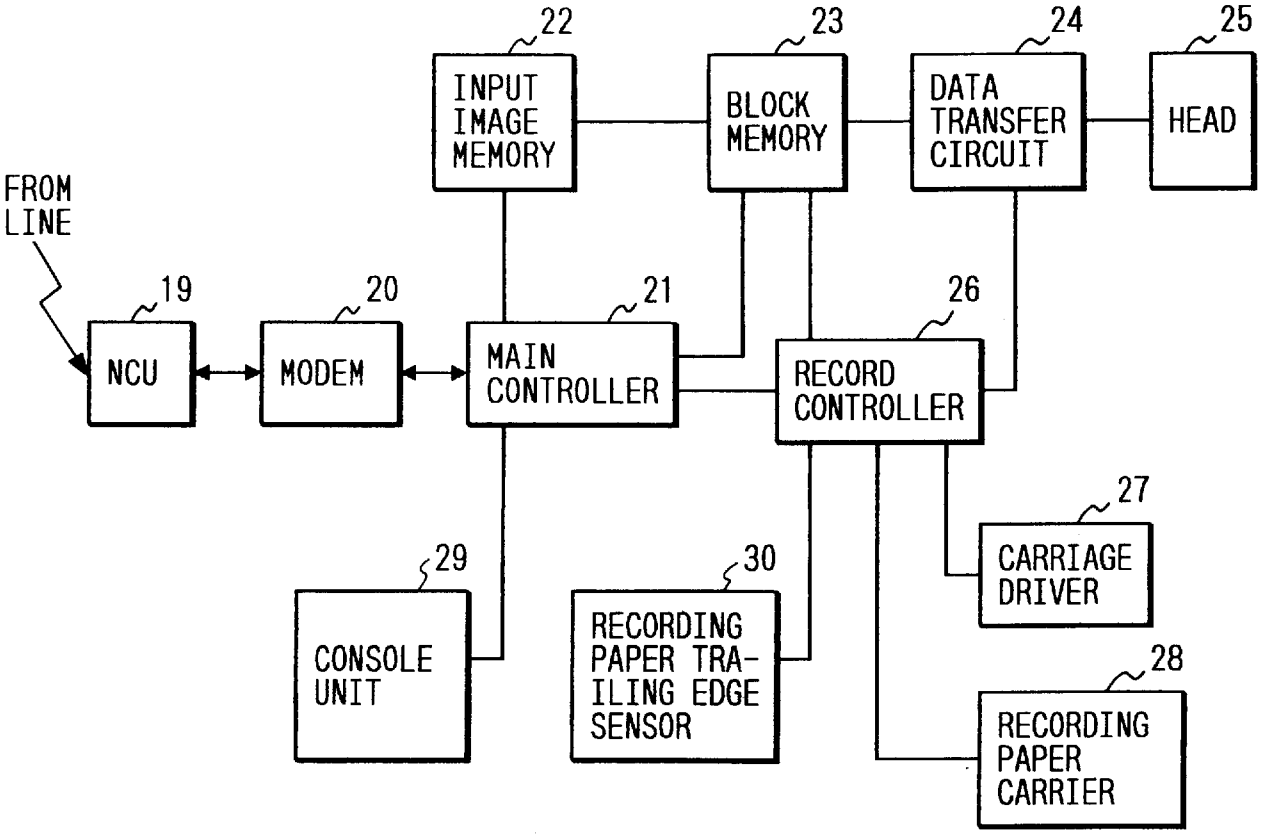
FIG. 3 shows a block diagram of a configuration of a control unit of the ink jet recording apparatus of the present invention.

FIG. 3 shows a block diagram of a control unit of the ink jet recording apparatus in the first embodiment of the present invention. Numeral 19 denotes a network control unit for controlling the connection with a line, numeral 20 denotes a modem for demodulating a received signal, numeral 21 denotes a main control unit for controlling the entire apparatus to transmit and receive data, and numeral 22 denotes an input image memory for storing received image information and transferring data in a form of raw data to a one-block memory 23 under the control of the main control unit 21.

In the present embodiment, the ink jet head is a semi-multi type head having several of nozzles (64 nozzles for 360 dpi in the present embodiment) which discharges ink droplets from discharge ports by causing a status change in the ink by using thermal energy and the recording apparatus is of shuttle type in which one page of information is scanned a plurality of times to record on the recording sheet. One block represents one scan of image data. In the present embodiment, the printing along a shorter side of a size B4 sheet is permitted and amount of one block of data is 64×3648 bits. Numeral 24 denotes a data transfer circuit for transferring the image data to a head 25, and numeral 26 denotes a record control unit comprising a one-chip microcomputer. Under the control of the record control unit 26, the data transfer to the head 25 and the drive of the head 25 are carried out and control signals are supplied to a carriage drive unit 27 and a recording sheet feed unit 28. The carriage drive unit 27 comprises a carriage motor and a motor drive, and the recording sheet drive unit 28 comprises a recording sheet feed motor such as a stepping motor for driving the recording sheet by one scan increment for each scan in a sub-scan direction and a motor driver. Numeral 29 denotes a console unit comprising LED and LCD for indicating the status of the present recording apparatus and operation keys for the recording apparatus. A temperature sensing device such as a thermistor for detecting a head temperature is mounted in the head 25 and a pulse width of a head drive voltage is controlled in accordance with the output of the temperature sensing device and a discharge history by the past print data.

FIG. 5 shows a flow chart of a control operation of the record control unit 6 for recording (printing) one block.

In a step S1, whether a print command has been received from the main control unit 21 or not is determined. When the print command is received, the image data to be printed has been transferred from the input image memory 22 to the one-block memory 23 as one-block raw data. If the decision is YES, whether the recording sheet is off the contact of the feed roller 12 and the pinch roller 13 or not is determined in a step S2 by the output of the recording sheet trailing edge sensor 30. If the recording sheet is not off the contact of the feed roller 12 and the pinch roller 13, the recording sheet trailing edge sensor 30 is ON and the process proceeds to a step S3 to determine the print direction of the previous block for conducting the bilateral printing.

A flag referred to in this step is a flag of the print direction reserved by the record control unit 26 each time one block is printed. If one block printing ends with the forward printing, "1" is set and if it ends with the backward printing, "0" is set. The forward direction corresponds to the print direction in the unilateral printing.

If the previous block is in the backward print direction in the step S3, the process proceeds to a step S5 to set "3648" in a counter N provided in the data transfer circuit 24 and "0" in a counter n. The counter n represents an address of the one-block memory 23 to read data. If the previous block was printed forwardly, the process proceeds to a step S4, and since the current block is to be backwardly printed, "0" is set in the counter N and "3648" is set in the counter n. If the previous block was printed backwardly as determined in the step S3, one line of heads of data is transferred in a step S10, and the data is printed in a step S12. After the completion of discharge for printing the carriage is moved by one line of the heads. The address of the one-block memory 23 to read the data is incremented in a step S13, and n=N is checked in a step S14. If the decision of n=N is YES, it means that the printing of one block of 3648 lines has been completed. If the printing is completed, whether a sheet eject command has been issued from the main control unit 21 or not is determined in a step S18, and if the decision is YES, the process proceeds to a step S19 to eject the sheet and terminate the printing of one page. If the sheet eject command has not been issued as determined in the step S18, "1" is set in the flag indicating the record direction in a step S15. If the decision in the step S14 is NO, the process returns to the step S10 to transfer the data of the next line of the block to print the data. If the previous block was printed forwardly as determined in the step S3, one line of heads of data is printed in the steps S6 to S8. Since the block is printed backward this time, "3648" is set in the counter n and "0" is set in the counter N in the step S4. In the step S8, the counter n is decremented, and in the step S9, n=N is checked. The read direction of the data from the one-block memory 23 is also backward. In the step S1, the flag is reset. If the printing of one block is completed in the step S9 or S14, the recording sheet is fed by one block (64 nozzles) length in a step S16 to complete the recording of one block. Then, a print command for the next block is monitored.

In the step S2, if the recording sheet trailing edge sensor 30 detects that the recording sheet is off the contact of the feed roller 12 and the pinch roller 13 by the feed of the recording sheet in the step S16 after the completion of the printing of the previous block, the process proceeds to a step S17 to reset the flag without regard to the record direction of the previously printed block to contact the printing forwardly.

As described above, by conducting the forward printing after the recording sheet 4 has been moved off the contact of the feed roller 12 and the pinch roller 13, the recording sheet 4 is biased to the platen 5 by the carriage wheel 2 so that the flatness of the recording sheet 4 is maintained and the sheet distance is stabilized and the print range is extended.

[Embodiment 2]

Figure 6:
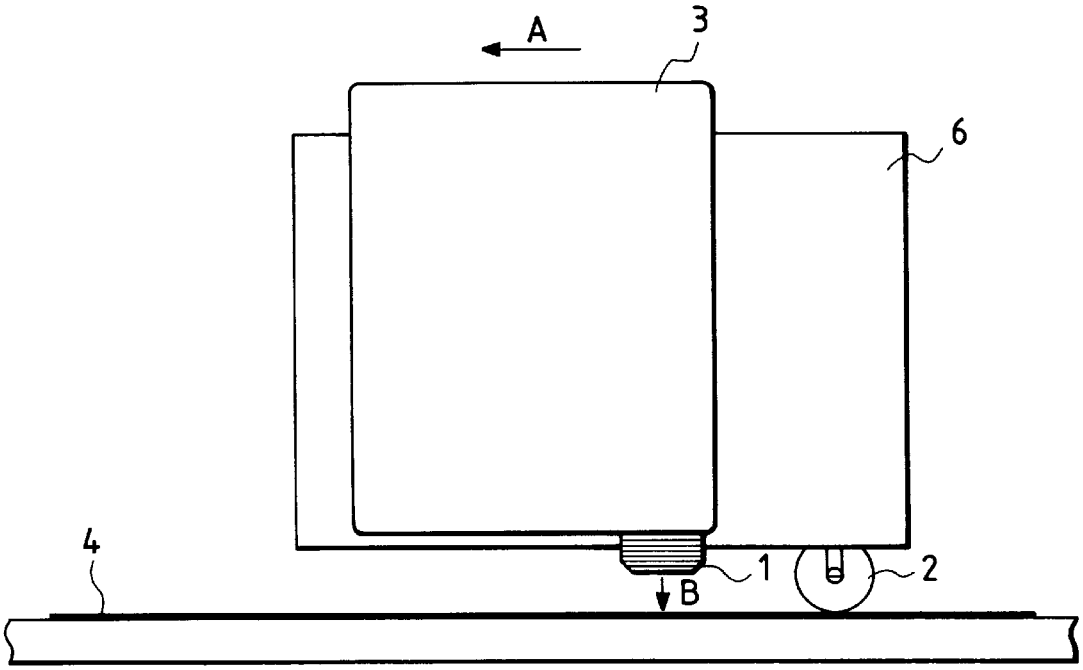
FIG. 6 shows a front view of a construction of a carriage in a second embodiment.

Referring to FIGS. 6 and 7, another embodiment of the ink jet recording apparatus of the present invention is explained. A general construction of the apparatus is identical to that of the first embodiment and the like elements are designated by the like numerals and the explanation thereof is omitted. In the present embodiment, the positional relation of the recording head 1 and the carriage wheel 2 is reversed so that the backward printing is conducted after the recording sheet 4 has been moved off the contact of the feed roller 12 and the pinch roller 13. The construction is now explained.

In FIG. 6, the positional relation of the recording head 1 and the carriage wheel 2 is such that the carriage wheel 2 is downstream of the recording head 1 as viewed in the print direction in the forward printing. Thus, when the carriage is moved backward while the recording sheet 4 is off the contact of the feed roller 12 and the pinch roller 13 and not driven, the recording sheet 4 is biased to the platen 5 by the carriage wheel 2 to keep the sheet distance constant.

FIG. 7 shows a flow chart of a control operation of the record control unit 26 for recording (printing) one block.

In the first embodiment, when the recording sheet trailing edge sensor 30 detects the trailing edge of the recording sheet, the forward printing flag is set to "0" in the step S17. In the present embodiment, when the recording sheet trailing edge is detected, the forward flag is set to "1" in a step S27. The remaining process is identical to that of FIG. 4 for the first embodiment.

Thus, in the step S2, when the microcomputer of the record control unit 26 determines that the recording sheet trailing edge sensor 30 has detected that the recording sheet has been moved off the contact of the feed roller 12 and the pinch roller 13 by the feed of the recording sheet in the step S16 after the completion of the printing of the previous block, the process proceeds to the step S27 to set the flag without regard to the record direction of the previously printed block to conduct the printing backwardly this time.

Accordingly, since the backward printing is conducted after the recording sheet 4 has been moved off the contact of the feed roller 12 and the pinch roller 13, the recording sheet 4 is biased to the platen by the carriage wheel 2 and the flatness of the recording sheet 4 is maintained and the sheet distance is stabilized, and the print range is extended.

[Embodiment 3]

Figure 8:
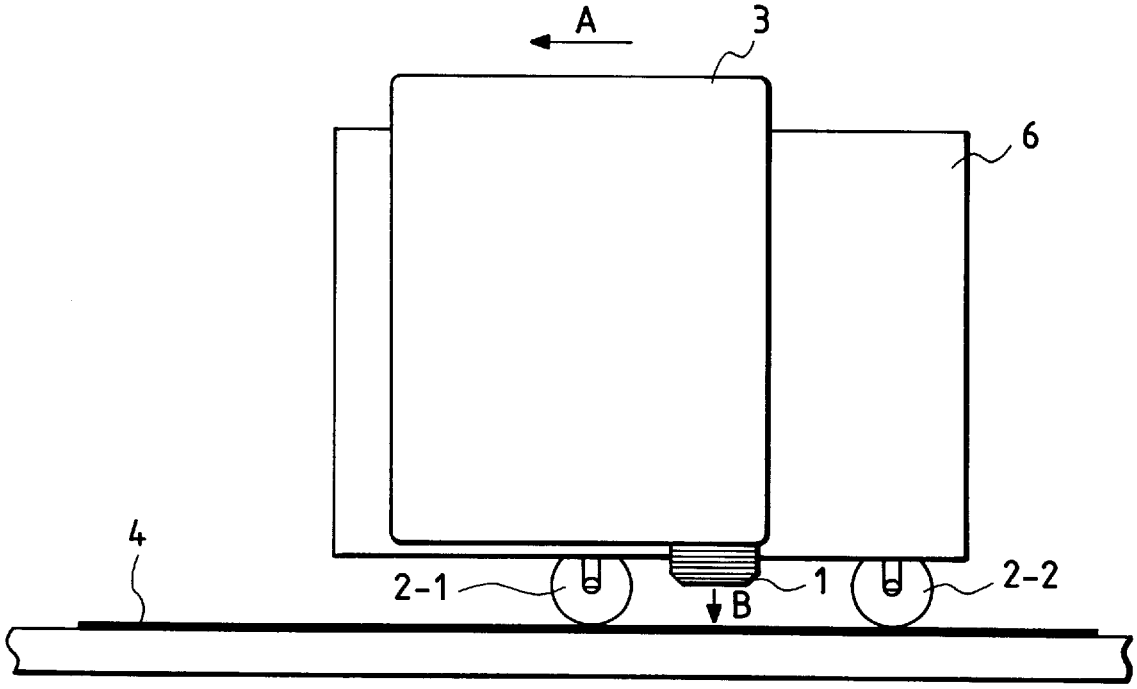
FIG. 8 shows a front view of a construction of a carriage in the third embodiment, the fourth embodiment and a fifth embodiment of the present invention.

Referring to FIGS. 5 and 8, other construction of the ink jet recording apparatus of the present invention is explained.

A general construction of the apparatus is identical to that of the first embodiment and the like elements are designated by the like numerals and the explanation thereof is omitted. In the present embodiment, carriage wheel 2-1 and 2-2 are arranged on the upstream and downstream sides of the recording head 1 relative to the direction of the reciprocal movement of the carriage 6, and the forward printing is conducted after the recording sheet 4 has been moved off the contact of the feed roller 12 and the pinch roller 13. The construction is now explained in detail.

In FIG. 8, the carriage wheels 2-1 and 2-2 are arranged on the upstream and downstream sides of the recording head 1 relative to the direction of the reciprocal movement of the carriage 6. Thus, when the recording sheet 4 is off the contact of the feed roller 12 and the pinch roller 13 and not driven and the carriage is moved forwardly and backwardly (bilaterally), the recording sheet 4 is biased by the carriage wheels 2-1 and 2-2 to keep the sheet distance constant.

A flow chart of the control operation in the present embodiment is identical to that of FIG. 5. Namely, before the recording sheet trailing edge sensor 30 detects in the step S2 that the recording sheet 4 has been moved off the contact of the feed roller 12 and the pinch roller 13, the forward printing and the backward printing are alternately repeated for each block to conduct the bilateral printing.

In the step S2, when the recording sheet trailing edge sensor 30 detects that the recording sheet has been moved off the contact of the feed roller 12 and the pinch roller 13 by the feed of the recording sheet in the step S16 after the completion of the printing of the previous block, the process proceeds to the step S17 to reset the flag without regard to the record direction of the previously printed block to conduct the forward printing this time.

By conducting the forward printing after the recording sheet 4 has been moved off the contact of the feed roller 12 and the pinch roller 13, the recording sheet 4 is biased to the platen 5 by the carriage wheels 2-1 and 2-2 so that the flatness of the recording sheet 4 is maintained, the sheet distance is stabilized and the record range is extended.

[Embodiment 4]

Referring to FIGS. 7 and 8, other construction of the ink jet recording apparatus of the present invention is explained. A general construction of the apparatus is identical to that of the first embodiment and the like elements are designated by the like numerals and the explanation thereof is omitted. In the present embodiment, carriage wheels 2-1 and 2-2 are arranged upstream and downstream of the recording head 1 relative to the direction of reciprocal movement of the carriage 6, and the backward printing is conducted after the recording sheet 4 has been moved off the contact of the feed roller 12 and the pinch roller 13.

A flow chart of the control operation of the present embodiment is identical to that of FIG. 5. Namely, before the recording sheet trailing edge sensor 30 detects in the step S2 that the recording sheet 4 has been moved off the contact of the feed roller 12 and the pinch roller 13, the forward printing and the backward printing are alternately repeated for each block to conduct the bilateral printing.

In the step S2, when the recording sheet trailing edge sensor 30 detects that the recording sheet 4 has been moved off the contact of the feed roller 12 and the pinch roller 13 by the feed of the recording sheet in the step S16 after the completion of the printing of the previous block, the process proceeds to the step S17 to set the flag without regard to the record direction of the previously printed block to conduct the backward printing this time.

By conducting the backward printing after the recording sheet 4 has been moved off the contact of the feed roller 12 and the pinch roller 13, the recording sheet 4 is biased to the platen 5 by the carriage wheels 2-1 and 2-2 so that the flatness of the recording sheet 4 is maintained, the sheet distance is stabilized and the print is extended.

[Embodiment 5]

Figure 9:
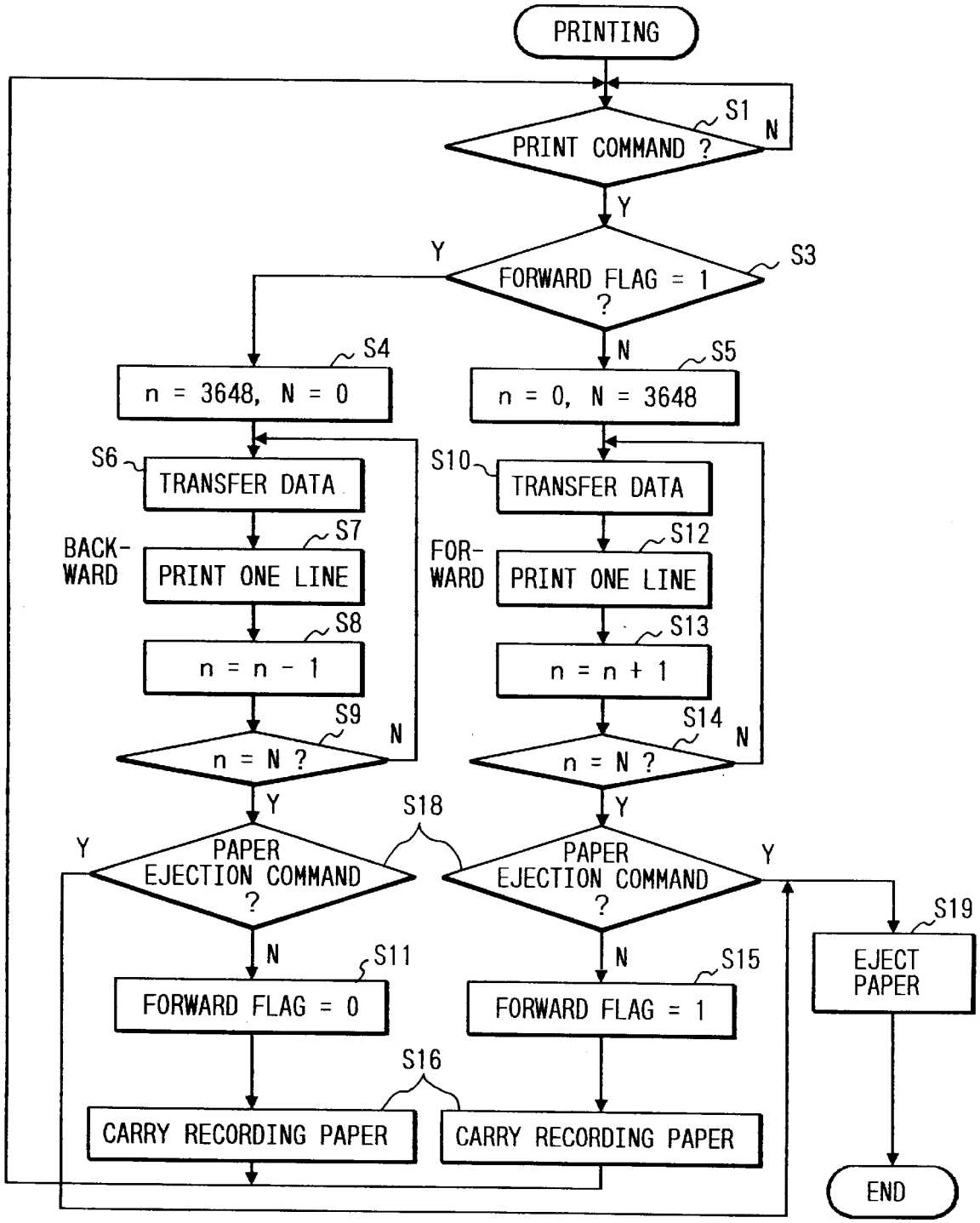
FIG. 9 shows a flow chart illustrating a control operation in the third embodiment and the fifth embodiment of the present invention.
Figure 10:
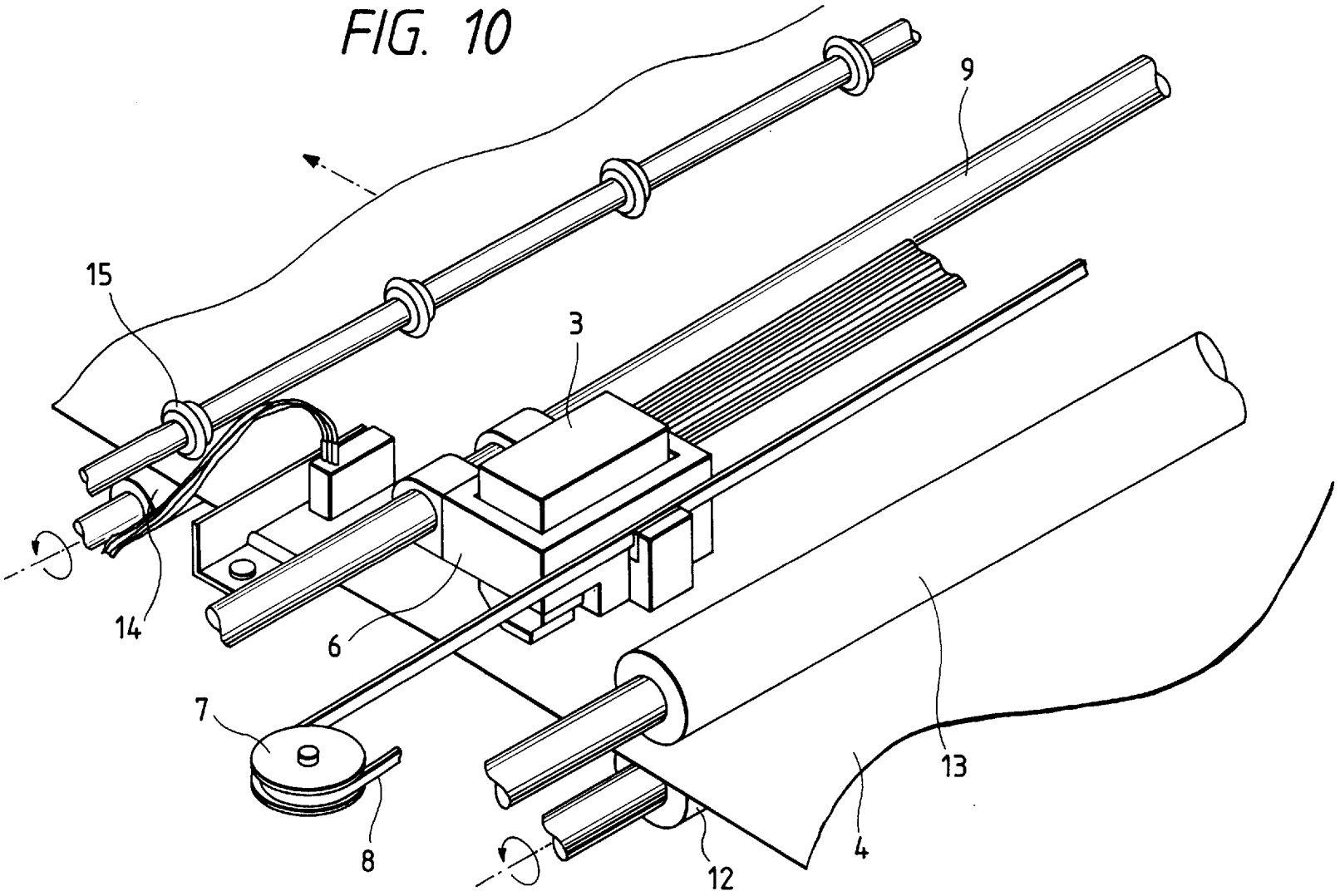
FIG. 10 shows a perspective view of a construction of a prior art ink jet recording apparatus.

Referring to FIGS. 8 and 9, other configuration of the ink jet recording head of the present invention is explained. A general construction of the apparatus is identical to that of the first embodiment and the like elements are designated by the like numerals and the explanation thereof is omitted. In the present embodiment, the carriage wheels 2-1 and 2-2 are arranged on the upstream and downstream sides of the recording head 1 relative to the direction of the reciprocal movement of the carriage 6 and the bilateral printing is conducted even after the recording sheet 4 has been moved off the contact of the feed roller 12 and the pinch roller 13. The construction is described in detail below.

FIG. 9 shows a flow of a control operation of the record control unit 26 to record (print) one block.

In a step S1, whether a print command has been received from the main control unit 1 or not is determined. When the print command is received, the print data to be printed has been transferred from the input image memory 22 to the one-block memory 23 as one-block raw data. If the decision is YES, the process proceeds to a step S3 to determine the print direction of the previous block to conduct the bilateral printing. A flag referred to is a flag of the print direction reserved by the record control unit 26 for each printing of block. It is set to "1" if the one-block recording ends with the forward printing, and set to "0" if it ends with the backward printing. The forward direction corresponds to the print direction in the unilateral printing. If the previous block was printed backward as determined in the step S3, the process proceeds to a step S5 to set "3648" in the counter N provided in the data transfer circuit 24 and set "0" in the counter n. The counter n indicates an address of the one-block memory to read the data. If the previous block was printed forwardly, the process proceeds to a step S4, and since the current block is to be printed backwardly, "0" is set in the counter N and "3648" is set in the counter n. If the previous block was printed backwardly as determined in the step S3, one line of heads of data is transferred in a step S10, and the data is printed in a step S12. After the completion of the discharge for printing, the carriage is moved by one line of heads distance. The address of the one-block memory 23 is incremented in a step S13, and n=N is checked in a step S14. If the decision of n=N is YES, it means that the printing of one block of 3648 dots has been completed. When the printing is completed, whether a sheet eject command has been issued or not is determined in a step S18, and if it has, the process proceeds to a step S19 to eject the recording sheet to complete the recording of one page. If the sheet ejection command has not been issued in the step S18, the flag indicating the record direction is set to "1" in the step S15. If the decision in the step S14 is NO, the process returns to the step S10 to transfer the data of the next line of that block to the head to print it. If the previous block was forwardly printed as determined in the step S3, one line of heads of data is printed in the steps S6 to S8. Since the block printed this time is the backwardly printed, "3648" is set in the counter n and "0" is set in the counter N in the step S4. In the step S8, the counter n is decremented and n=N is checked in the step S9. The direction of reading of the data from the one-block memory 23 is also reversed. In the step S11, the flag is reset. If the printing of one block is completed in the step S9 or S14, the recording sheet is fed by one block distance in the step S16 to complete the recording of one block. Then, a print command for the next block is monitored. The same operation is continued even when the recording sheet 4 is off the contact of the feed roller 12 and the pinch roller 13.

As described above, by conducting the bilateral printing even after the recording sheet 4 has been moved off the contact of the feed roller 12 and the pinch roller 13, the recording sheet 4 is biased to the platen 5 by the carriage wheel 2 so that the flatness of the recording sheet 4 is maintained, the sheet distance is stabilized and the print range is extended.

As described above, by providing the members upstream and downstream of the recording head as viewed in the direction of the movement of the recording head and biasing the recording sheet to the platen by the members, the sheet distance can be stabilized. By controlling the print direction, the printing can be conducted even after the recording head has been moved off the contact of the feed roller 12 and the pinch roller 13 and the print range is extended.

By providing the members on the upstream and downstream sides of the recording head as viewed in the direction of the movement of the recording head, the bilateral printing can be conducted even after the recording sheet has been moved off the contact of the feed roller 12 and the pinch roller 13, and the print range is extended and the print time is shortened.

The above embodiments are particularly directed to the ink jet recording apparatus which reforming forming flying droplets by utilizing thermal energy.

The typical construction and the operational principles are preferably the ones disclosed in U.S. Pat. Nos. 4,723,129 and 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of a pulse because the development and the contraction of the bubbles can be effected instantaneously, and therefore the liquid (ink) is ejected with fast response.

The driving pulse signal is preferably such as those disclosed in U.S. Pat. Nos. 4,463,359 and 4,345,262. In addition, the temperature rise rate of the heating surface is preferably such as those disclosed in U.S. Pat. No. 4,313,124 so as to achieve excellent recording.

The structure of the recording head may be those shown in U.S. Pat. Nos. 4,558,333 and 4,459,600 in which the heating portion is disposed at a bent portion, as well as the structure (linear or orthogonal liquid passage) of the combination of the ejection outlet, liquid passage and the electro-thermal transducer disclosed in the above-mentioned patents.

In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port.

The present invention is effectively applicable to a so-called full-line type recording head having a length corresponding to the maximum recording width. Such a recording head may comprise a single recording head formed as one unit or a combination of recording heads disclosed in the before mentioned patents to cover the length.

In addition, the present invention is applicable to a replaceable chip type recording head which is connected electrically with the apparatus and can be supplied with the ink when it is mounted in the main assembly, or to a cartridge type recording head integrally equipped with the recording head.

The provisions of the recovery means and/or the auxiliary means for the preliminary operation are preferable because they further stabilize the effects of the present invention. As for such means, there are capping means for the recording head, cleaning means therefor, pressurizing or suction means, preliminary heating means which may be an electro-thermal transducer, an additional heating element or a combination thereof. Also, means for effecting preliminary discharge (not for the recording) may stabilize the recording operation.

The present invention is effectively applicable to an apparatus having at least one of a monochromatic mode mainly with black, a multi-color mode with different color inks and/or a full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied.

In addition, the temperature rise due to the thermal energy is positively prevented by consuming it for the state change of the ink from the solid state to the liquid state. Another ink is solidified when it is left unused, to prevent the evaporation of the ink. In any case, the application of the recording signal producing thermal energy, the ink is liquefied, and the liquefied ink may be discharged. Another ink may start to be solidified at the time when it reaches the recording sheet. The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a word processor a computer or the like, as a copying machine combined with an image reader or the like, or as a facsimile machine having information sending and receiving functions.

What is claimed is:

1. An ink jet recording apparatus for recording an image on a recording medium with a recording head for discharging ink droplets in accordance with image data, said apparatus comprising:

moving means for reciprocally moving said recording head relative to said recording medium;

feed means for feeding said recording medium to a record position by said recording head;

detection means for detecting passage of a trailing edge of said recording medium through said feed means; and control means for selecting a record mode in accordance with an output of said detection means, wherein said control means selects a first record mode in which recording is conducted in each of forward movement and backward movement of said moving means before said detection means detects the passage of the trailing edge of said recording medium and selects a second record mode in which the recording is conducted in one of the forward movement and the backward movement of said moving means after the detection of the passage of the trailing edge of said recording medium by said detection means.

2. An ink jet recording apparatus according to claim 1, wherein said moving means comprises carrying means for carrying said recording head, and said carrying means comprises a member for maintaining a constant distance between an ink discharge plane of said recording head and said recording medium.

3. An ink jet recording apparatus according to claim 2, wherein said member is provided on said carrying means such that said member is upstream of the ink discharge plane of said recording head as viewed in a direction of recording movement of said recording head in said second record mode.

4. An ink jet recording apparatus according to claim 3, wherein said member comprises a wheel.

5. An ink jet recording apparatus according to claim 2, wherein said member comprises plural members provided upstream and downstream of the ink discharge plane of said recording head as viewed in a direction of movement of said recording head by said drive means.

6. An ink jet recording apparatus according to claim 5, wherein said plural members comprise wheels.

7. An ink jet recording apparatus according to claim 2, wherein said member comprises a wheel.

8. An ink jet recording apparatus according to claim 1, wherein said carrying means comprises a pair of rollers for pinching said recording medium therebetween for feeding.

9. An ink jet recording apparatus according to claim 1, further comprising:

receiving means for receiving image data transmitted through a line, wherein said recording head records the image on said recording medium by discharging ink droplets in accordance with the image data received by said receiving means.

10. An ink jet recording apparatus according to claim 1, wherein said recording head comprises heating means and discharges ink droplets by causing a state change in ink by applying thermal energy generated by said heating means.

11. An inkjet recording apparatus for recording an image on a recording medium with a recording head, equipped with a plurality of recording elements disposed in an ink discharge plane, for discharging ink droplets in accordance with image data, said apparatus comprising:

carrying means for carrying said recording head;

moving means for reciprocally moving said recording head carried by said carrying means relative to said recording medium in a main scan direction, said main scan direction being different from an arrangement direction of the plurality of recording elements;

feed means for feeding said recording medium to a record position by said recording head, said feed means feeding said recording medium in a sub-scan direction different from the main scan direction; and actuation means for actuating said recording head to conduct recording in forward movement or backward movement of said moving means, wherein said carrying means comprises wheel members for maintaining a constant distance between the ink discharge plane of said recording head and said recording medium, said wheel members being located upstream and downstream of the ink discharge plane of said recording head as viewed in the main scan direction.

12. An ink jet recording apparatus according to claim 11, further comprising:

receiving means for receiving image data transmitted through a line, wherein said recording head records the image on said recording medium by discharging ink droplets in accordance with the image data received by said receiving means.

13. An ink jet recording apparatus according to claim 11, wherein said recording head comprises heating means and discharges ink droplets by causing a state change in ink by applying thermal energy generated by said heating means.

14. An ink jet recording apparatus for recording an image on a recording medium with a recording head for discharging ink droplets in accordance with image data, said apparatus comprising:

moving means for reciprocally moving said recording head relative to said recording medium;

feed means for feeding said recording medium to a record position by said recording head;

detection means for detecting a trailing edge of said recording medium in a vicinity of said feed means; and control means for selecting a record mode in accordance with an output of said detection means, wherein said control means selects a first record mode in which recording is conducted in each of forward movement and backward movement of said moving means before said detection means detects the trailing edge of said recording medium and selects a second record mode in which the recording is conducted in one of the forward movement and the backward movement of said moving means after the detection of the trailing edge of said recording medium by said detection means.

15. An ink jet recording apparatus according to claim 14, wherein said moving means comprises carrying means for carrying said recording head, and said carrying means comprises a member for maintaining a constant distance between an ink discharge plane of said recording head and said recording medium.

16. An ink jet recording apparatus according to claim 15, wherein said member is provided on said carrying means such that said member is upstream of the ink discharge plane of said recording head as viewed in a direction of recording movement of said recording head in said second record mode.

17. An ink jet recording apparatus according to claim 16, wherein said member comprises plural members provided upstream and downstream of the ink discharge plane of said recording head as viewed in a direction of movement of said recording head by said drive means.

18. An ink jet recording apparatus according to claim 15, wherein said member comprises a wheel.

19. An ink jet recording apparatus according to claim 18, wherein said member comprises a wheel.

20. An ink jet recording apparatus according to claim 15, wherein said plural members comprise wheels.

21. An ink jet recording apparatus according to claim 14, wherein said carrying means comprises a pair of rollers for pinching said recording medium therebetween for feeding.

22. An ink jet recording apparatus according to claim 14, further comprising:

receiving means for receiving image data transmitted through a line, wherein said recording head records the image on said recording medium by discharging ink droplets in accordance with the image data received by said receiving means.

23. An ink jet recording apparatus according to claim 14, wherein said recording head comprises heating means and discharges ink droplets by causing a state change in ink by applying thermal energy generated by said heating means.

* * * * *

UNITED STATES PATENT AND TRADEMARK OFFICE

CERTIFICATE OF CORRECTION

PATENT NO. : 5,859,653 Page 1 of 2

DATED : January 12, 1999

INVENTOR(S) : AOKI ET AL.

It is certified that error appears in the above-indentified patent and that said Letters Patent is hereby corrected as shown below:

On the title page: Item

[56] References Cited:

FOREIGN PRIORITY DOCUMENTS, "403182356" should read --3-182356--.

COLUMN 4:

Line 54, "several" should read --several tens--.

COLUMN 6:

Line 2, "S1," should read --S11,--.

COLUMN 9:

Line 28, "reforming" should read --records by--.

UNITED STATES PATENT AND TRADEMARK OFFICE

CERTIFICATE OF CORRECTION

PATENT NO. : 5,859,653

DATED : January 12, 1999

INVENTOR(S) : AOKI ET AL.

It is certified that error appears in the above-indentified patent and that said Letters Patent is hereby corrected as shown below:

COLUMN 10:

Line 21, "means," (first occurrence) should read --means, and--.

COLUMN 11:

Line 56, "inkjet" should read --ink jet--.

Signed and Sealed this

Twenty-fifth Day of April, 2000

*Attest:*

Q. TODD DICKINSON

*Attesting Officer*

*Director of Patents and Trademarks*